United States Patent [19]

Mitts et al.

[11] 3,969,656

[45] July 13, 1976

[54] ELECTRIC IGNITER CONSTRUCTION

[75] Inventors: Richard K. Mitts, Fullerton; Wilbur F. Jackson, Rolling Hills; James R. Willson, Garden Grove, all of Calif.

[73] Assignee: Robertshaw Controls Company, Richmond, Va.

[22] Filed: July 8, 1974

[21] Appl. No.: 486,294

Related U.S. Application Data

[63] Continuation of Ser. No. 318,791, Dec. 27, 1972, Pat. No. 3,823,345, which is a continuation of Ser. No. 107,767, Jan. 19, 1971, abandoned, which is a continuation-in-part of Ser. No. 807,509, March 17, 1969, Pat. No. 3,562,590.

[52] U.S. Cl. ..... 317/98; 219/270; 219/552; 431/262

[51] Int. Cl.[2] ..... F23Q 7/10

[58] Field of Search ..... 219/260, 267, 270, 553; 317/98; 123/145; 338/296; 431/66, 259, 262, 263

[56] References Cited

UNITED STATES PATENTS

| | | | |
|---|---|---|---|
| 2,149,868 | 3/1939 | Rabezzama | 123/145 |
| 2,404,841 | 7/1946 | Hess et al. | 317/98 |
| 2,487,753 | 11/1949 | Cohn | 317/98 X |
| 2,487,754 | 11/1949 | Cohn | 317/98 X |
| 3,551,083 | 12/1970 | Michaels | 431/66 |
| 3,569,787 | 3/1971 | Palmer | 317/98 |
| 3,577,209 | 5/1971 | Perkins | 317/98 |
| 3,774,077 | 11/1973 | Raffaelli et al. | 317/98 |
| 3,812,324 | 5/1974 | Raffaelli et al. | 219/553 |
| 3,823,345 | 7/1974 | Mitts et al. | 317/98 |

*Primary Examiner*—J. V. Truhe
*Assistant Examiner*—Clifford C. Shaw
*Attorney, Agent, or Firm*—Anthony A. O'Brien

[57] ABSTRACT

An electric igniter assembly including a casing in which the major length of the igniter element is enclosed so that only a small portion is disposed in proximity to a gas burner; the electrical connectors for the igniter element and the electrodes that are attached to power leads are disposed remote from the flame issuing from the gas burner as well as being fixedly supported in the casing which includes shock absorbent material to reduce possibilities of breakage of the igniter element. A shield mounted upon the casing surrounds the igniter element so as to readily enable direct ignition of the gas burner and thereafter protect the igniter from direct burner flame impingement.

2 Claims, 10 Drawing Figures

FIG. 8
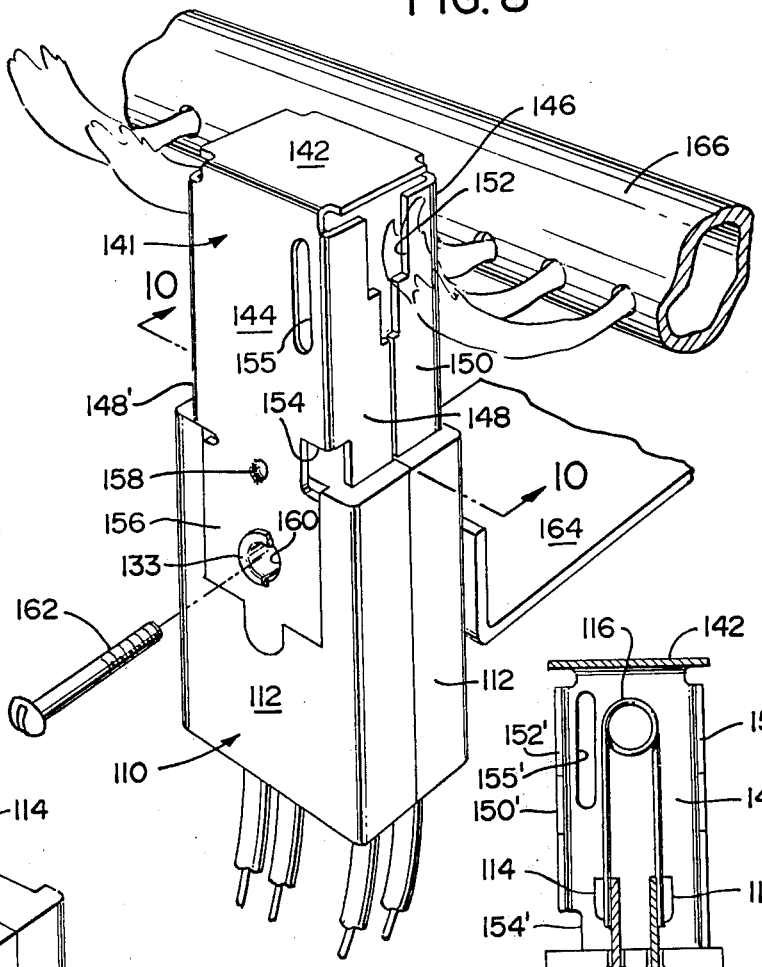
FIG. 9
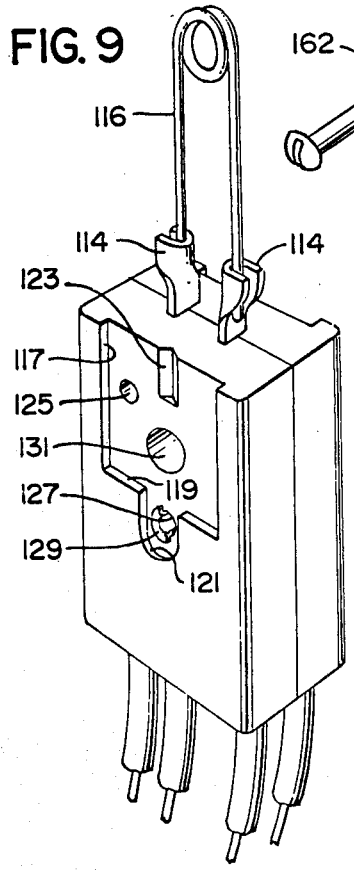
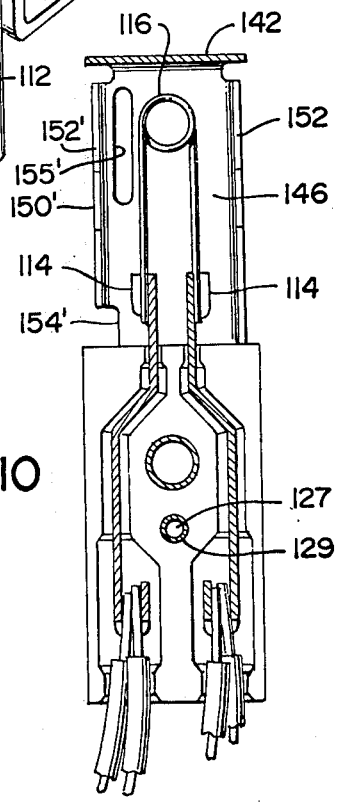
FIG. 10

ELECTRIC IGNITER CONSTRUCTION

CROSS-REFERENCE TO RELATED APPLICATION

This application is a continuation application of pending application Ser. No. 318,791, filed Dec. 27, 1972, now U.S. Pat. No. 3,823,345 which is a continuation application of application Ser. No. 107,767 now abandoned, filed Jan. 19, 1971 as a continuation-in-part of application Ser. No. 807,509, filed March 17, 1969, now U.S. Pat. No. 3,562,590 issued Feb. 9, 1971.

BACKGROUND OF THE INVENTION

This invention relates generally to the construction of an igniter device of the type that would be used to light the burner of a gas burning appliance.

Certain materials are particularly suited for use as these igniters due to the excellent resistance to oxidation, resistance to thermal shock, resistivity, coefficient of thermal resistance and a high melting temperature. Among such materials are molybdenum disilicide, tungsten disilicide and silicon carbide. As an example of such igniter wires, reference is made to U.S. Patent No. 3,522,574 which illustrates a typical high temperature, refractory metal silicide igniter and a particular technique for heat-sink mounting of the same. Igniter wires made out of such a material have certain defects such as the fact that the fragility of such material makes them highly susceptible to breakage. Another defect resides in the fact that an igniter wire made of such a material required support from the electrodes so that the length of the igniter wire was limited resulting in the connection between the igniter wire and the electrodes being in close proximity to the flame issuing from the burner. Thus, both the igniter element and the electrodes were subject to direct burner flame impingement resulting in reduced igniter life and inefficient igniter operation.

SUMMARY OF THE INVENTION

It is therefore an object of the present invention to construct an igniter assembly that will overcome the foregoing defects and at the same time have the desirable features of being low in cost, accurate in operation, and simple in design so as to be easy to manufacture and assemble.

Another object of the present invention is to construct an electric igniter assembly with an igniter element that is supported throughout a major portion of its length.

The present invention has another object in that the electric connectors for an igniter element are located remote from the igniter portion which is disposed in igniting proximity to the burner.

It is another object of the present invention to provide an igniter assembly with a high temperature supporting material to reduce the amount of igniter material that is susceptible to impact failure.

The present invention has a further object in the construction of an electric igniter having high electrical power dissipation within a preselected ignition zone for reducing the igniter temperature necessary for ignition.

Another object of this invention is to provide an igniter assembly with a shield member which surrounds the igniter element so as to enable ignition while precluding direct burner flame impingement.

A further object of the present invention is to provide an igniter assembly and its shield with a resilient layer of material therebetween to absorb impact shock.

The present invention is summarized in that an electric igniter construction includes a housing, an igniter element having an igniting portion and connectable portions, electrical conductor means electrically connected to the connectable portions of the igniter element, the electrical conductor means being fixedly supported in the housing with the igniter element suspended therefrom, and a shield carried by the housing surrounding the igniter element to shield the same from direct burner flame impingement, with the shield defining port means for ignition and for air circulation through the shield.

These and other objects and advantages of the present invention will become apparent from the following detailed description viewed in conjunction with the accompanying drawings.

BRIEF DESCRIPTION OF THE DRAWINGS

FIG. 8 is a perspective view of another embodiment of an electric igniter with a shield constructed in accordance with the present invention;

FIG. 9 is a perspective view of the electric igniter of FIG. 8 with the shield removed; and FIG. 10 is a longitudinal cross section of the electric igniter of FIG. 8.

DESCRIPTION OF THE PREFERRED EMBODIMENTS

Figure 1:
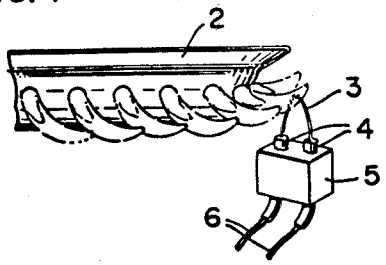
FIG. 1 is a partial schematic view showing the positioning relationship of an electric igniter to a gas burner.

As is illustrated in FIG. 1, a main burner 2 is supplied with fuel gas from a main supply (not shown) and an igniter 3 is attached to the main burner 2 in igniting proximity thereto. The igniter element 3 is located in the flame issuing from the main burner and is electrically connected to a pair of electrodes 4 that are fixed in a casing 5 of temperature resistant material such as a ceramic. The other end of the electrodes 4 are connected to a pair of lead wires 6 for connection to an electrical voltage source (not shown).

One of the more desirable materials to be utilized as the electric igniter wire for gas burners is molybdenum disilicide because of its excellent oxidation resistance as well as its high resistance to thermal shock. Of course, other materials may also serve as the igniter element of an electric igniter. While it is possible to utilize a variety of materials as elements for electric igniters in the laboratory and/or on the drawing board, they have a fatal defect in being susceptible to breakage during installation on the gas burning appliances or during subsequent shipment of the appliances. Thus the electric igniter wire 3 as shown in FIG. 1 not only would be susceptible to the problem of breakage but would have a further defect in that reliable electrical connections to the electrode terminals would be difficult to ensure because of their subsequent exposure to the burner flames.

Figure 2:
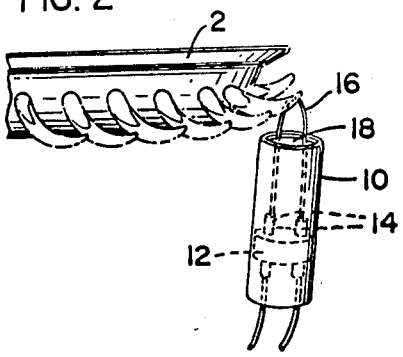
FIG. 2 is a partial schematic view similar to FIG. 1 embodying the present invention.

As is illustrated in FIG. 2, the first embodiment of the present invention overcomes the above difficulties without displacing the igniter from the flames of the main burner 2. The igniter construction of FIG. 2 includes an outer cylindrical shell 10 having a support plug 12 in the form of a solid cylinder fixed inside the casing 10 intermediate the ends thereof. A pair of electrodes 14 extend through and are fixedly supported by the support plug 12. The lower ends of the electrodes 14 (as viewed in FIG. 2) are connected to a pair of lead wires which extend out of the open bottom of the casing 10 for connection to a suitable electric voltage source (not shown). The upper ends of the electrodes 14 are electrically connected to an inverted generally U-shaped wire 16 which has its looped end protruding out of the casing 10 to define the igniting portion that is disposed in igniting proximity to the main burner 2. The electric igniter 16 is preferably made of molybdenum disilicide; however, similar materials exhibiting characteristics of being resistant to oxidation and to thermal shock may also be utilized for the igniter 16.

The space between the top of the support plug 12 and the open end of the casing 10 is filled with a high temperature resistance potting compound 18. Since the potting compound 18 surrounds the lower portion of the igniter wire 16, it acts as an additional supporting structure for the entire igniter wire 16 and substantially reduces the amount of igniter material that is susceptible to impact failure. In addition, the amount of igniter wire that is exposed to the burner flames, is a relatively short length and the connections to the electrodes 14 are remote from the burner flames and are likewise protected by the supporting compound 18.

Figure 3:
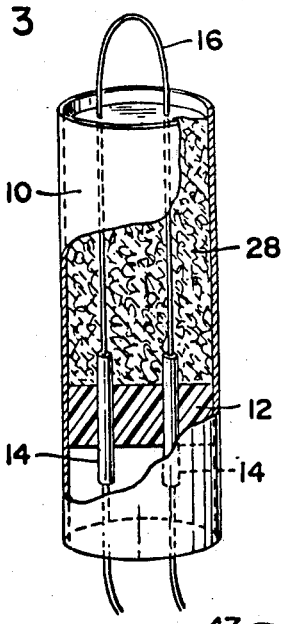
FIG. 3 is an isometric view with parts in section of an electric igniter construction forming a second embodiment of the present invention.

In the following description of the subsequent embodiments of the invention, the same reference numerals will be utilized for the same structural elements that have been described in connection with FIG. 2 and further description thereof will be omitted for the sake of brevity. For example, the embodiment of FIG. 3 differs from the embodiment of FIG. 2 only with respect to the supporting compound that is used to support the encased ends of the igniter wire 16. Thus in FIG. 3 a high temperature resistant flexible material 28 is disposed in the space between the upper surface of the support plug 12 and the open end of the casing 10. A particular example of this high temperature resistant flexible material is glass wool which would not only help to support the igniter wire 16 throughout its length in the casing 10 but would also help to absorb shock loads imparted to the casing 10.

Figure 4:
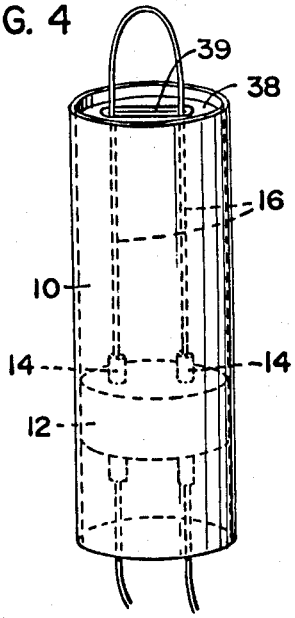
FIG. 4 is an isometric view of an electric igniter forming a third embodiment of the present invention.
Figure 5:
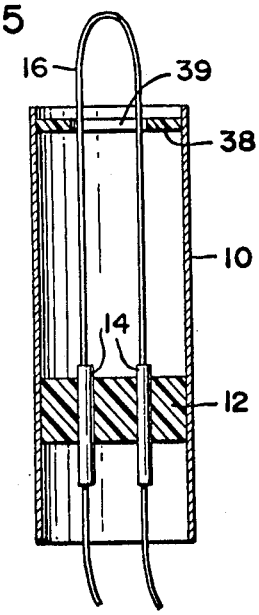
FIG. 5 is a longitudinal cross section of FIG. 4.

In the embodiment illustrated in FIGS. 4 and 5, the open end of the casing 10 is provided with a support disc 38 having a central slot 39 through which the looped end of the igniter wire 16 protrudes. The support disc 38 is fixed to the interior of the casing 10 in any suitable manner and is located adjacent to the open end thereof so as to provide an upper support for the igniter wire 16. The support disc 38 may touch the igniter wires at each end of its slot or may be merely positioned in close proximity thereto to prevent excessive movement of the igniter wire 16. The support disc 38 may be made of any suitable temperature resistant material such as a thermosetting resin. As is illustrated in FIG. 5, the space in the casing between the upper surface of the support plug 12 and the support disc 38 is not filled with any supporting material; however, if desired this space could be filled with glass wool or the like as similarly described in connection with the embodiment of FIG. 3.

A desirable feature in the design of an electric igniter assembly is to construct a device with a current draw of less than 5 amperes under all conditions of primary line voltage change. The 5 ampere maximum current draw is necessary in order to stay within the limits of a Class II transformer as defined by Underwriters' Laboratories. It is also desirable to reduce the igniter element temperature as much as possible, while ensuring ignition of the fuel, so as to extend igniter life and reduce maintenance costs. The maximum current draw of an igniter assembly is found by first determining the minimum current necessary to ignite a burner. This minimum current is found at the minimum primary voltage. The maximum current draw is found then under the same conditions, but with maximum primary voltage. Four things influence the maximum current draw of the igniter: the first is lighting efficiency; the second is the amount of self-heat received by the igniter material; the third is the temperature coeffiecient of resistance of the material; and the fourth is the wire size and configuration.

With the igniters utilizing a material, such as molybdenum disilicide, having a positive temperature coefficient of resistance, i.e., the resistance increases with an increase in temperature, any means of increasing the heating efficiency of the igniter will in turn effect a resistance increase of the igniter and thus increase the voltage and decrease the current draw. It has been found by experimentation that the current draw of an igniter can be substantially reduced by means of a properly designed igniter shield. The igniter shield helps to increase the lighting efficiency of the igniter; i.e., the igniter will effect ignition of a burner at a reduced temperature because it spoils the cooling effect of the gas. The shield also reflects heat back to the igniter, thus increasing the igniter temperature for a given power or current draw, and thus raising the resistance of the igniter and reducing the maximum current draw of the assembly.

Figure 6:
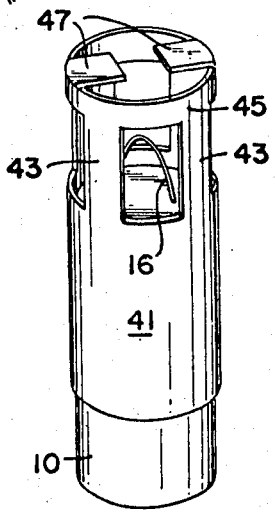
FIG. 6 is an isometric view of an electric igniter with a shield thereon.

As is illustrated in FIG. 6, an igniter shield 41 has a lower portion fixed in any suitable manner to the exterior of the igniter casing 10. Even though the igniter casings 10 as shown in FIGS. 2-5, have a circular configuration they are not necessarily limited to such a shape but may take any other cross sectional configuration as desired. Accordingly, even though the shield 41 of FIG. 6 is in the form of a hollow cylinder the lower portion thereof need not have any particular shape but need only be of sufficient dimensions to be fixed to the casing 10 and to protect the flame side thereof. The upper end of the shield 41 includes a plurality of arcuate surfaces 43 (in this instance a plurality of 4) which are arranged in opposing pairs on opposite sides of the igniter wire 16. An annulus 45 joins the upper edges of the reflecting surfaces 43 and has a pair of inwardly bent tabs 47. The tabs 47 provide additional reflective surfaces for the igniter wire 16 and further protect the same from coming in contact with any foreign object.

Figure 7:
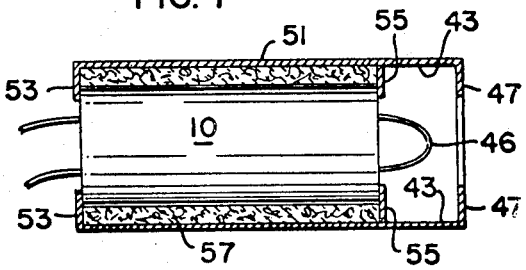
FIG. 7 is a cross section of an electric igniter having a shield and a cushioning layer thereon.

The shield 41 with its reflective surfaces 43, annulus 45 and tabs 47 may be constructed as a single unit as is illustrated in FIGS. 6 and 7 or may be constructed as separate elements secured together in any suitable manner.

As is illustrated in FIG. 7, the shield 51 is substantially the same as that shown in FIG. 6 except that it has dimensions greater than the igniter casing 10 both in length and width. The lower end (or left end as viewed in FIG. 7) of the shield 51 has a plurality of inwardly bent tabs 53 being of sufficient dimension to engage the bottom of casing 10. A plurality of similarly inwardly bent tabs 55 are located near the opposite end of the shield 51 in order to engage the upper end of the casing 10. With the casing 10 being so held between the tabs 53 and 55 the space between the outer wall of the casing 10 and the shield 51 is filled with a layer of resilient material 57 that will absorb impact between the shield 51 and the igniter casing 10. For example, if the assembly shown in FIG. 7 should be dropped, the shield 51 will first receive the impact but the shock will be reduced by the resilient material 57 before being transmitted to the igniter casing 10.

Another desirable feature in the design of an electric igniter assembly is to construct a device wherein the igniter element is completely shielded from direct burner flame impingement. This, of course, becomes an extremely important factor when the completed igniter assembly is to be used for direct burner ignition rather than for pilot ignition since continued exposure to the main burner flame results in increased oxidation and rapid deterioration of the igniter element.

Such an igniter assembly is illustrated in FIGS. 8, 9 and 10 and parts similar to parts described with respect to the above embodiments are given identical reference numbers with 100 added thereto.

In the embodiment of the present invention illustrated in FIG. 8, the igniter assembly includes an outer housing or casing, indicated generally at 110, having the configuration of a parallelepiped and including a pair of mating support members 112 which cooperate to fixedly support a pair of electrodes or terminal strips 114 (FIG. 10) which extend longitudinally therethrough. As seen in FIGS. 9 and 10, each of the terminals 114 is in the form of a flat metal strip which is mediately offset to conform to longitudinally oriented offset grooves defined by the interior surfaces of support members 112. The terminal strips 114 may also include laterally extending locating tabs, if desired, to hold the terminals in place during assembly of the two halves of the casing 110.

Referring to FIG. 10, the lower ends of the terminal strips 114 are connected to a pair of main lead wires which extend out of the open bottom of the casing or housing 110 for connection to a suitable power source (not shown). A second pair of wires may also be connected with the terminal strips 114 for sensing and/or monitoring purposes. Both sets of wires are attached to the terminals 114 by any suitable means such as by crimping and soldering in order to assure a positive electrical connection. Each of the upper ends of the terminals 114 is bent to form a generally U-shaped upright channel adapted to receive the ends of an inverted generally U-shaped igniter wire 116 which has its looped end extending away from the housing 110 to define the igniting portion thereof. As seen in FIG. 9, the electric igniter 116 is rigidly attached at its ends to the terminal strips 114 as by brazing so as to be suspended therefrom for facilitating ignition. The electric igniter 116 may have a U-shaped configuration similar to that illustrated and described with respect to the preceding embodiments or may include one or more loops as shown in FIG. 9. The igniter 116 is preferably made of molybdenum disilicide; however, similar materials exhibiting oxidation and thermal shock resistant characteristics may also be utilized if desired.

Formed in each of the opposite exterior surfaces of the support members 112 of housing 110 is one of a pair of identical longitudinally oriented generally rectangular grooves or channels 117 (FIG. 9) extending from the upper edge of the support members to a central portion thereof and terminating in a flat wall 119 having a semicircular centrally disposed offset surface 121. A short, narrow groove 123 is located in the floor of each channel 117 adjacent the upper edge of the support members, and a small bore 125 in the floor of the channel extends interiorly of the housing 110 in communication with the interior grooves which support the electrodes or terminal strips 114. Bore 125 enables the injection of a suitable cement into the interior grooves to prevent terminal movement in the completed assembly.

A second small bore 127 is located centrally of the semicircular surface 121 of wall 119, with the bores of each support member 112 being aligned so as to receive an eyelet 129 which firmly secures the support members together to form the housing 110. Another bore 131 similarly extends transversely through the central portion of each support member 112 with the bores of each support member being aligned to receive an additional eyelet 133 (FIG. 8) after assembly of a shield 141 onto the housing 110.

As can be seen in FIGS. 9 and 10, the two support members 112 of housing 110 may be identical in construction and designed to cooperatively mate with each other so as to simplify manufacture and reduce costs. Of course, it should be recognized that other particular shapes aside from the generally rectangular shape described herein may be utilized for the support members, such as a cylindrical shape, for example, depending upon the desired installation.

Shield 141 is formed from a flat sheet of a suitable flame resistant material, such as sheet metal, which is initially folded to provide two upper corners defining an inverted generally U-shaped configuration having a top wall 142 and a pair of side walls or reflector elements 144 and 146. The side walls 144 and 146 each include a pair of inwardly bent tabs 148—148′ and 150—150′, respectively, which meet so as to define a generally rectangular closed shell which is slightly smaller in cross-section than the corresponding dimensions of housing 110. It is noted that top wall 142 of the shield is slightly wider than the shield width so as to overhang the lateral sides of the shield for assisting ignition. Each of the tabs 148—148′ and 150—150′ is cut to form a step-like edge as shown in FIG. 8 such that a pair of shaped lateral ports 152—152′ is provided for enabling communication between gas issuing from the main burner and the interior of the shield. A pair of notches 154—154′ are cut out from two of the lower, diagonally opposite corners of the shield 141 to form air inlet ports for providing air circulation through the shield and for cooling the igniter terminals at their point of attachment. In this manner, the temperature of the brazed or soldered igniter 116-to-terminal 114 joint is prevented from becoming excessive during operation. In addition, a pair of upright slotted ports 155—155′ are cut through side walls 144 and 146 of the shield adjacent the upper corners thereof. Ports 155—155′ provide proper air-gas flow into the shield for ignition under "high wind" conditions as might be encountered with a roof-top installation.

The shield 141 also includes a pair of mounting tabs 156 extending downwardly from each of the side walls 144 and 146 and shaped to conform to the inner dimensions of channels 117. Each of the mounting tabs includes an aligning dimple 158 which cooperates with grooves 123, and a hole 160 which is aligned with bores 131 to receive eyelet 133. Eyelet 133 is attached in place after the shield 141 is positioned on the housing 110 and serves to hold the shield firmly in position; the eyelet also serves to receive a mounting screw 162 which cooperates with a suitable bracket 164 for maintaining the assembly in igniting proximity with a main burner 166 as is illustrated in FIG. 8.

It should be recognized that shield 141 may be constructed as a single unit as is illustrated in FIGS. 8 and 10 or may be constructed element by element, with the separate elements secured together in any suitable manner.

The shield 141 is particularly advantageous in operation in that it both assures ignition of the main burner 166 and protects the igniter element 116 from direct flame impingement subsequent to ignition. More specifically, just prior to the establishment of gas flow from the main burner, electric current is applied to the igniter 116 causing it to rapidly become heated to fuel igniting temperatures. As stated above with respect to shields 41 and 51 of the embodiments of FIGS. 6 and 7, it is desirable that the igniter draw a minimal amount of current under all conditions of primary line voltage change in order to increase the useful life of the igniter element 116. The shield 141 has been found to advantageously maintain the current drawn by igniter 116 within suitable low limits because it increases the igniting efficiency of the igniter element by spoiling the cooling effect of the gas emanating from the burner and by reflecting heat back to the igniter to increase its temperature for a given current draw. Thus, by substantially completely enclosing the igniter element, a greater amount of heat is developed both by reflection of heat back to the igniter and by minimization of draft cooling. These considerations, especially when enhanced by the use of an igniter constructed of a material having a positive temperature coefficient of resistance, serve to maintain the igniter resistance at a high value so as to reduce the maximum current draw of the assembly.

After the igniter is energized and a flow of gas from the burner is established, the raw fuel will flow around the shield and past the lateral ports 152 and 152′ whereupon some of the gas will pass into the interior of the shield due to the "stepped" configuration of the ports and the slight overhang of the top wall 142. At this same time, a restricted amount of primary air will be drawn into the interior of the shield through the lower air intake ports 154 and 154′ to assist in ignition and to cool the terminal portions of the igniter element 116. The moderately turbulent flow within the shield caused by the flow of gas past the shaped ports 152 and 152′, the air intake from ports 154 and 154′ and the flow of air past slotted ports 155 and 155′ produce the proper gas-air mixture within the shield for ignition by the igniter element 116.

once ignition has been accomplished, the burner flame produces an updraft around the igniter assembly which causes a relatively greater amount of air to be drawn into the interior of the shield 141 through air intake ports 154—154′. Consequently, combustion products are prevented from accumulating inside the shield, and the burner flame is prevented from entering the area of the igniter element 116. In this manner, the igniter element is isolated from direct flame impingement thereby avoiding increased wear and oxidation which might otherwise occur. Of course, direct flame impingement is further curtailed by the unbroken side wall 146 of the shield which, as seen in FIG. 8, is adapted to be directly interposed between the igniter and the burner 166.

It is also pointed out that the lead wires extending from the bottom of the casing 110 and the connections to terminal strips 114 are disposed remote from the burner so that damage thereto from the burner flame is effectively eliminated. The isolation of terminal strips 114 and the wires from the flame is further enhanced by the shield 141 and the housing 110 which cooperatively surround these elements whereby any amount of heat which might be ultimately applied thereto is insufficient to cause damage or deterioration of the electrical connections or the insulation of the lead wires.

While shield 141 of FIGS. 8 and 10 has been illustrated and described in connection with the rectangular housing 110, it should be understood that shield 141 may be utilized with equal efficacy with the circular igniter assemblies of the preceding embodiments. Thus, mounting tabs 156 need not be flat but may be curved slightly to conform to the circular dimensions of housing 10 and suitable mechanical attachments made to secure the shield in place.

The igniter element 116 is constructed from a length of wire made of a refractory material exhibiting good oxidation and thermal shock resistant characteristics which is bent to form a loop at its distal end. Superior results have been obtained where the wire diameter is in the range of 0.024 inches to 0.035 inches and elements constructed of such wire have exhibited outstanding mechanical strength (i.e., low fragility), long life, and high electrical power dissipation characteristics enabling operation at relatively low temperatures. One such element, for example, was formed of a wire constructed of molybdenum disilicide having a diameter of 0.03 which was bent to form a 1½ coil loop as illustrated in FIGS. 9 and 10. The length of the element from the terminal ends thereof to the center of the loop was approximately 35/64inches, the inner diameter of the loop was approximately 0.187 inches with overlapping loop portions separated by 0.018 inches to 0.035 inches, and the terminal ends of the loop were separated by approximately 13164 inches. The above element was found to be capable of providing ignition at operating temperatures of less than 2500°F with the minimum operating temperature lying in the range of approximately 1800°F to 1875°F.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. An igniter element for use in an electric igniter assembly for a gas burner comprising an electrically resistive wire made of molybdenum disilicide, said wire having an operating temperature less than 2500° F. and having a diameter less than 0.035 inches, said wire having terminal ends and an intermediate portion therebetween, electrical lead means connecting said terminal ends to a source of electrical power, said intermediate portion of said wire being coiled into substantially one and one-half loops, and overlapping portions of said loops being spaced from each other by a distance in the range of 0.018 inches to 0.035 inches.

2. An igniter element for use in an electric assembly for a gas burner comprising an electrically resistive wire made of molybdenum disilicide, said wire having an operating temperature in the range of 1800°F. to 2500°F. and having a diameter less than 0.035 inches, said wire having terminal ends and an intermediate portion therebetween, electrical lead means connecting said terminal ends to a source of electrical power, said intermediate portion of said wire being coiled into at least one and one-half loops and overlapping portions of said loops being spaced from each other by a distance of the range of 0.018 inches to 0.035 inches, each loop having an inner diameter of approximately 0.187 inches, and each terminal end extending from the center of said loops approximately 35/64 inches.

* * * * *